US011234460B2

(12) United States Patent
Strohl

(10) Patent No.: US 11,234,460 B2
(45) Date of Patent: Feb. 1, 2022

(54) SMOKING IMPLEMENT CONTAINER AND SPINNER COMBINATION ASSEMBLY

(71) Applicant: Jacob Strohl, Bloomington, MN (US)

(72) Inventor: Jacob Strohl, Bloomington, MN (US)

( * ) Notice: Subject to any disclaimer, the term of this patent is extended or adjusted under 35 U.S.C. 154(b) by 221 days.

(21) Appl. No.: 16/575,505

(22) Filed: Sep. 19, 2019

(65) Prior Publication Data

US 2021/0084969 A1 Mar. 25, 2021

(51) Int. Cl.

| | |
|---|---|
| ***A24F 15/18*** | (2006.01) |
| ***B65D 25/04*** | (2006.01) |
| ***A63F 9/00*** | (2006.01) |
| ***A63F 5/04*** | (2006.01) |
| ***B65D 25/20*** | (2006.01) |

(52) U.S. Cl.

CPC ..... *A24F 15/18* (2013.01); *A63F 5/045* (2013.01); *A63F 9/001* (2013.01); *B65D 25/04* (2013.01); *B65D 25/205* (2013.01); *A63F 2009/0012* (2013.01)

(58) Field of Classification Search

CPC ..... A24F 15/18; A24F 15/08; A63F 5/045; A63F 9/001; A63F 2009/0012; B65D 85/109; B65D 85/10; B65D 85/1009

USPC ..... 206/236

See application file for complete search history.

(56) References Cited

U.S. PATENT DOCUMENTS

| | | | | |
|---|---|---|---|---|
| 2,821,074 A * | 1/1958 | Kirkpatrick | A24F 27/20 431/271 |
| 4,164,999 A * | 8/1979 | Tsukamoto | A24F 15/18 206/91 |
| 6,042,113 A * | 3/2000 | Walker | A24F 27/12 206/103 |
| 6,474,342 B1 * | 11/2002 | Rennecamp | A24F 23/04 131/241 |
| 2008/0314778 A1 * | 12/2008 | Hatton | A24F 9/00 206/256 |

* cited by examiner

*Primary Examiner* — Steven A. Reynolds

(57) ABSTRACT

A smoking implement container and spinner combination assembly includes a housing having a bottom wall and a perimeter wall. The housing has a top side having a first opening and a second opening extending therethrough. A first compartment is positioned in the housing and has an interior is aligned with the first opening. A second compartment is positioned in the housing and has an interior aligned with the second opening. The first and second openings are closable. A disc is rotatably mounted on the housing. The disc has an outer surface having indicia thereon dividing the outer surface into a plurality of sections. Each of the sections has an action indicia thereon. A pointer is mounted on the housing and extends over the outer surface to indicate one of the sections after rotation of the disc terminates.

7 Claims, 5 Drawing Sheets

SMOKING IMPLEMENT CONTAINER AND SPINNER COMBINATION ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to smoking game device and more particularly pertains to a new smoking game device for playing a game whereby participants take turn with a spinner directing particular actions by the participants.

(2) Description of Related Art Including Information Disclosed Under 37 CFR 1.97 and 1.98

The prior art relates to smoking game devices but which further includes means for holding the articles used in the smoking process.

BRIEF SUMMARY OF THE INVENTION

An embodiment of the disclosure meets the needs presented above by generally comprising a housing having a bottom wall and a perimeter wall that is attached to and extends upwardly from the bottom wall. The perimeter wall includes a front wall, a rear wall, a first side wall and a second side wall. The housing has a top side having a first opening and a second opening extending therethrough. A first compartment is positioned in the housing adjacent to the first side wall and has an interior is aligned with the first opening. A second compartment is positioned in the housing adjacent to the second side wall and has an interior aligned with the second opening. The first and second openings are closable. A disc is rotatably mounted on the housing. The disc has an outer surface facing away from the housing. The outer surface has indicia thereon dividing the outer surface into a plurality of sections. Each of the sections has an action indicia thereon. A pointer is mounted on the housing and extends over the outer surface to indicate one of the sections after rotation of the disc terminates.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
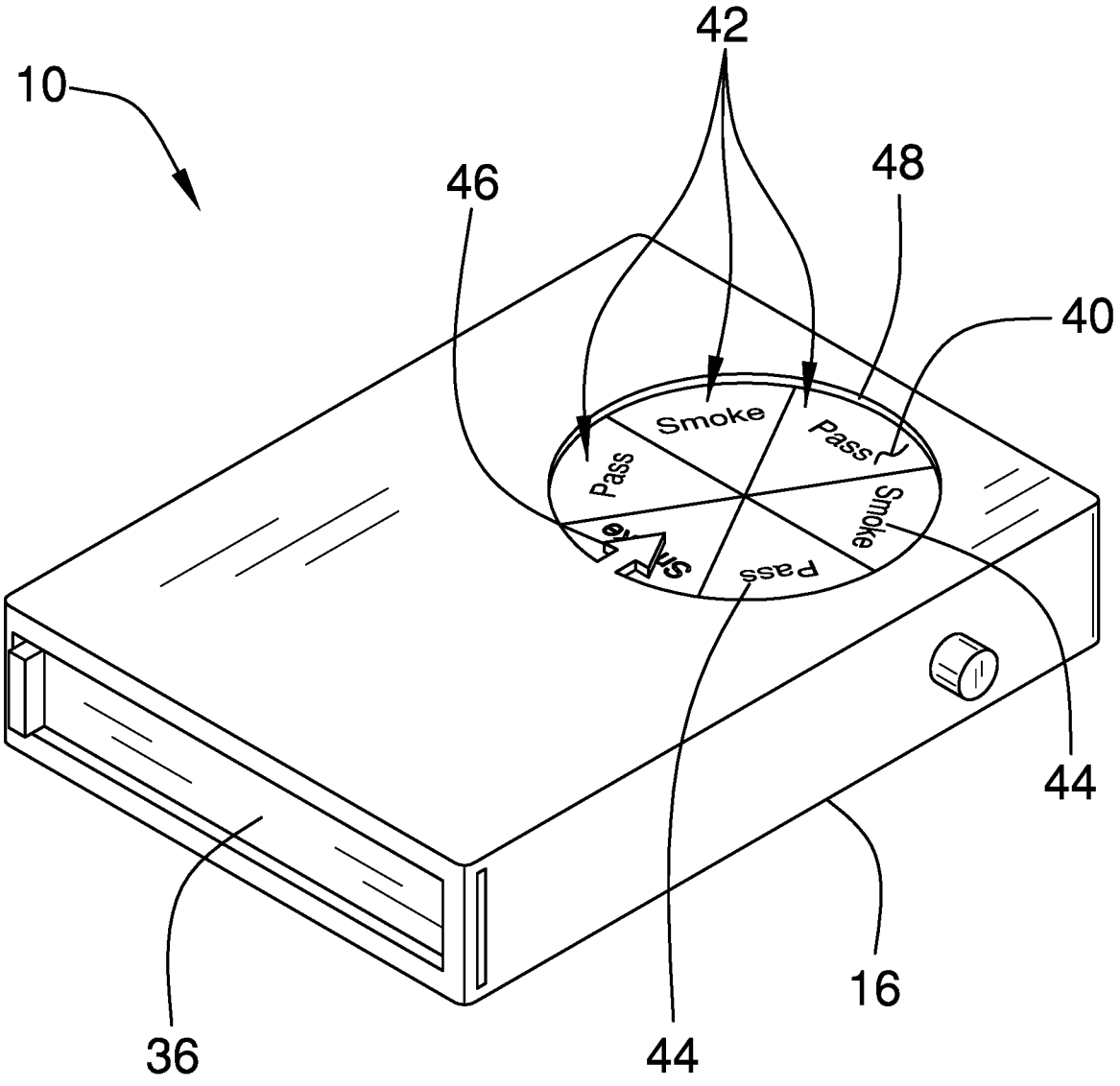
FIG. 1 is a top and front isometric view of a smoking implement container and spinner combination assembly according to an embodiment of the disclosure.

With reference now to the drawings, and in particular to FIGS. 1 through 6 thereof, a new smoking game device embodying the principles and concepts of an embodiment of the disclosure and generally designated by the reference numeral 10 will be described.

As best illustrated in FIGS. 1 through 6, the smoking implement container and spinner combination assembly 10 generally comprises a housing 12 that has a bottom wall 14 and a perimeter wall 16 which is attached to and extends upwardly from the bottom wall 14. The perimeter wall 16 includes a front wall 18, a rear wall 20, a first side wall 22 and a second side wall 24. The housing 12 has a top side 26 having a first opening 28 and a second opening 30 extending therethrough. The housing 12 typically has a height between 2.0 inches and 5.0 inches, a width from the first side wall 22 to the second side wall 24 between 2.0 inches and 4.0 inches and a depth being less than 2.0 inches. The housing 12 may be comprised of any rigid material including wood, plastics, metals and the like.

A first compartment 32 is positioned in the housing 12 adjacent to the first side wall 22 and has an interior that is aligned with the first opening 28. A second compartment 34 is positioned in the housing 12 adjacent to the second side wall 24 and has an interior aligned with the second opening 30. The housing 12 is generally known as a dugout used for holding articles for smoking. As can be seen in the Figures, the first compartment 32 may be elongated and is used typically for holding a small pipe. The second compartment 34 may have any shape but is used for holding the material to be smoked and inhaled by the user of the assembly 10.

The second compartment 34 will typically have a shallower depth than the first compartment 32.

Figure 2:
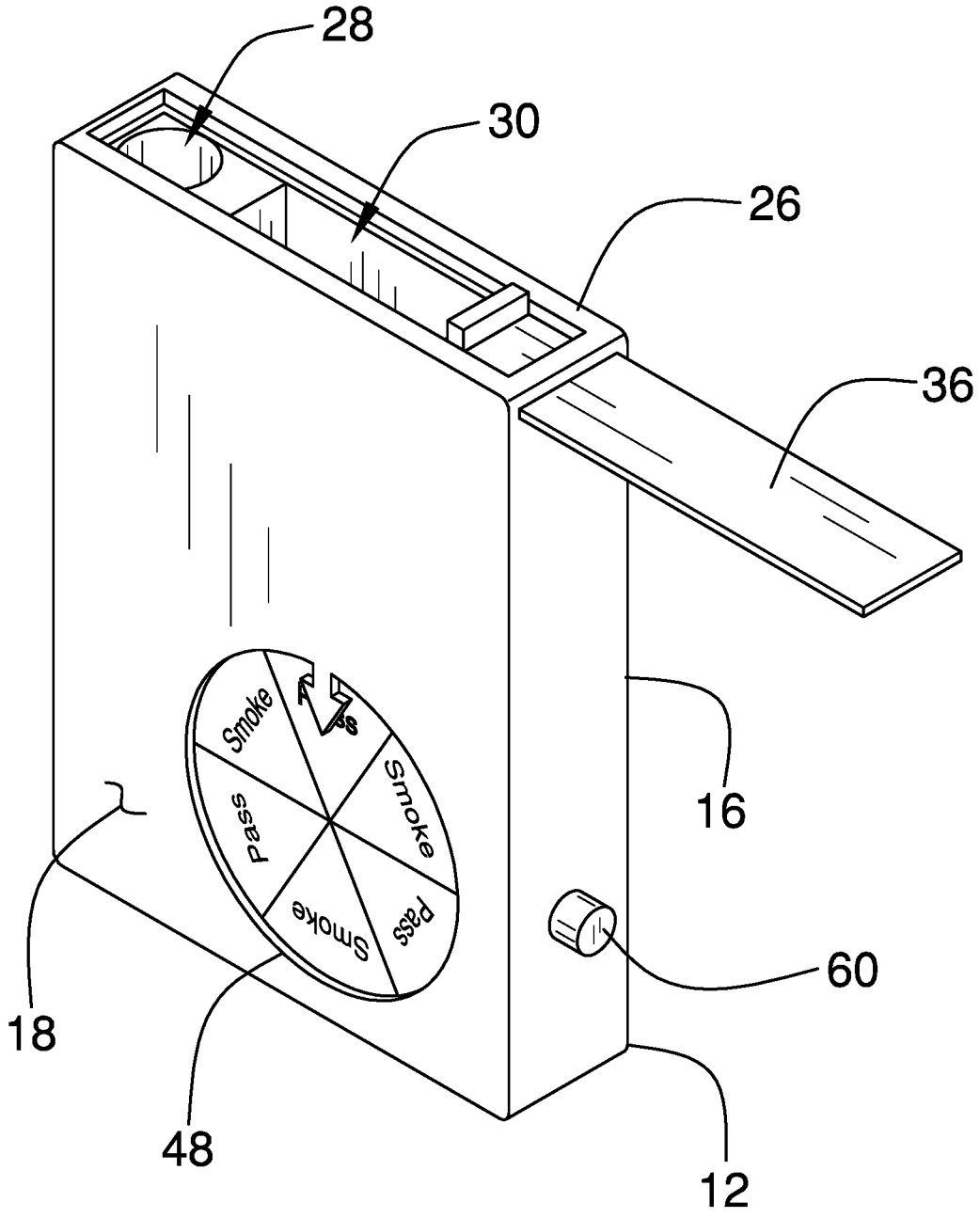
FIG. 2 is a front and top isometric view of an embodiment of the disclosure.
Figure 4:
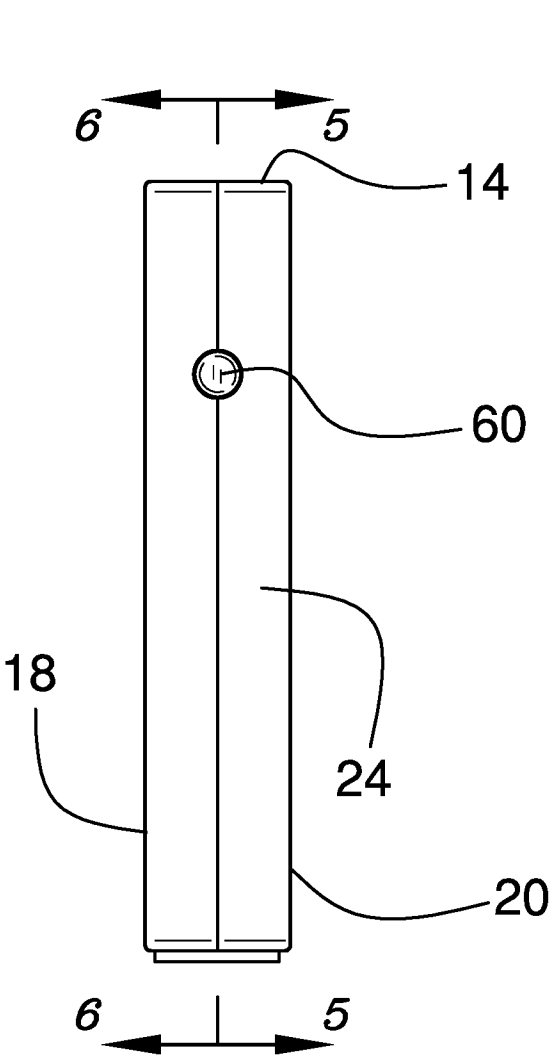
FIG. 4 is a side view of an embodiment of the disclosure.
Figure 3:
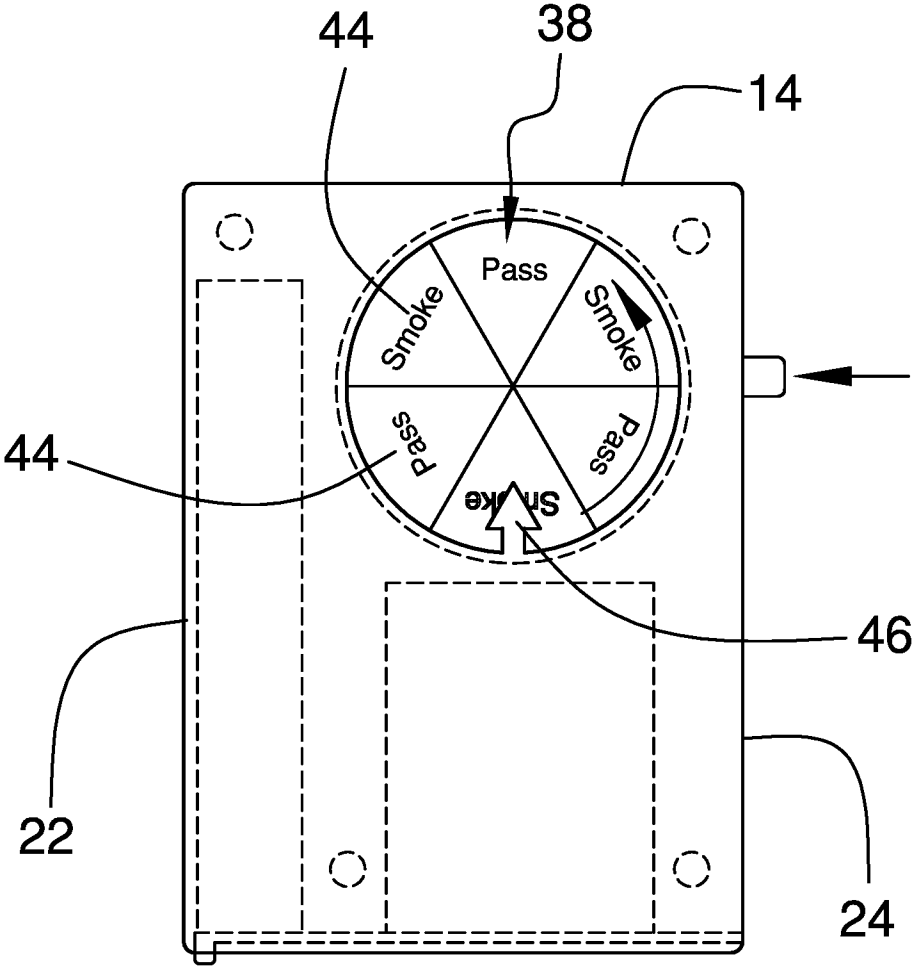
FIG. 3 is a front view of an embodiment of the disclosure.

The first 28 and second 30 openings are openable and closable. This may be achieved with a door 36 is positioned on the housing 12. The door 36 is movable to open or close the first 28 and second 30 openings. As can be seen in FIG. 2, the door 36 may comprise a panel that is slidable across the top side 26 to cover the first 28 and second 30 openings. Typically, the door 36 will be mounted on the housing 12 such that the first opening 28 will be exposed before the second opening 30.

A disc 38 is rotatably mounted on the housing 12. The disc 38 has an outer surface 40 facing away from the housing 12. The outer surface 40 has indicia thereon dividing the outer surface into a plurality of sections 42. Each of the sections 42 has an action indicia 44 thereon. The action indicia 44 will at least include an action indicating that the person should smoke or an action that the person should pass, but other options may be included or altered depending on desired outcomes by the user. Thus, when a group of people are using the housing 12, the disc 38 can be used as a game to determine when a person will or will not use the pipe. A pointer 46 is mounted on the housing 12, the pointer 46 extends over the outer surface 40 and indicates one of the sections 42 after rotation of the disc 38 terminates. The pointer 46 is used to determine which action will be controlling for a person's spin or turn. The front wall 18 has an aperture 48 therein. The disc 38 is positioned in the housing 12 and is viewable through the aperture 48. The pointer 46 is mounted on the front wall 18 and extends over the aperture 48.

Figure 5:
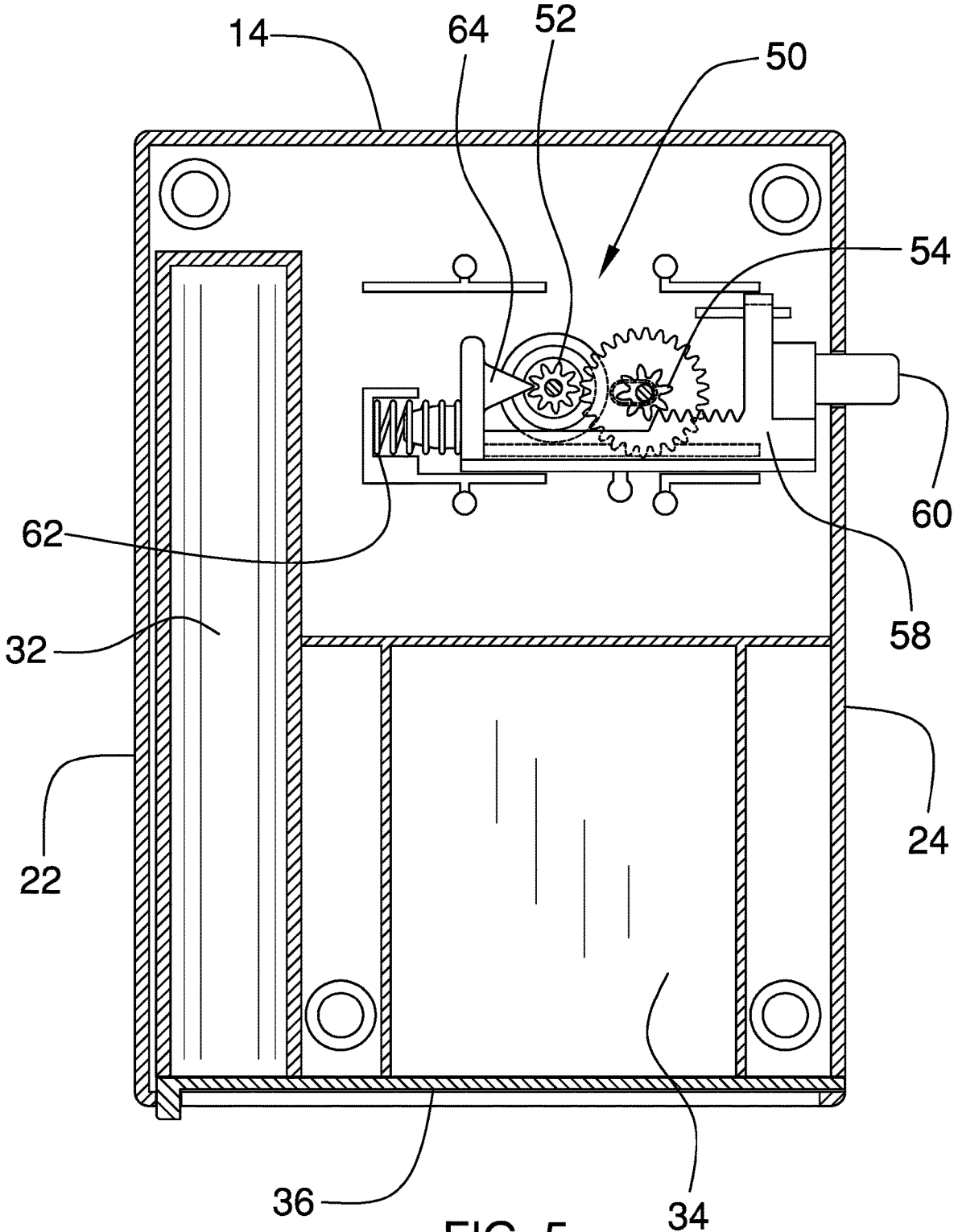
FIG. 5 is a cross-sectional view of an embodiment of the disclosure taken along line 5-5 of FIG. 4.
Figure 6:
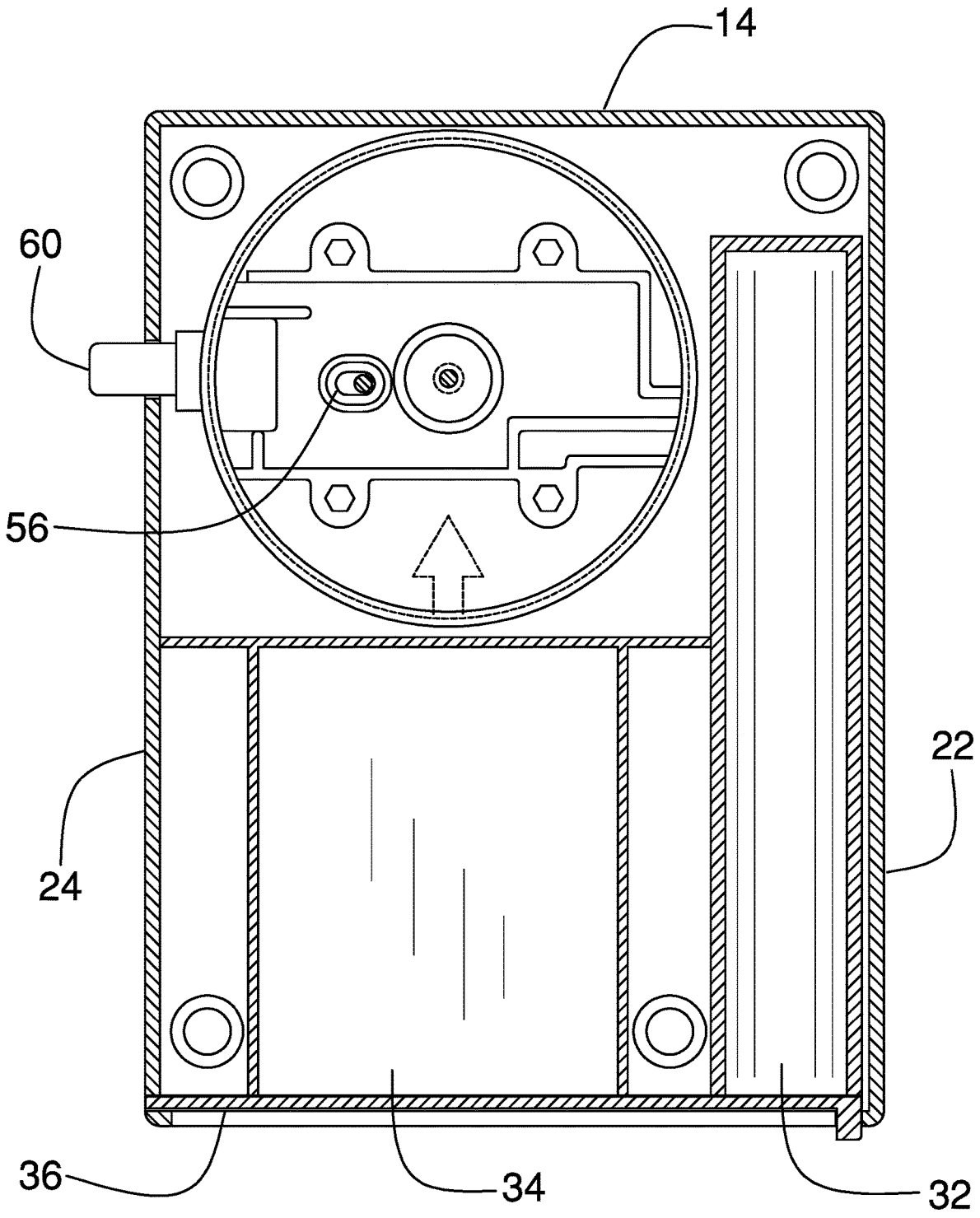
FIG. 6 is a cross-sectional view of an embodiment of the disclosure taken along line 6-6 of FIG. 4.

A spin actuator 50 is mechanically coupled to the disc 38. The spin actuator 50 is actuated to cause the disc 38 to rotate. While any number of spin actuators 50 may be utilized, one favorable construction includes a disc gear 52 that is mounted on a backside of the disc 38. An intermediate gear 54 is rotatably mounted to the housing 12. The intermediate gear 54 is mounted in a slot 56 such that the intermediate gear 54 is movable between an engaged position engaging the disc gear 52 and a disengaged positioned being disengaged from the disc gear 52. A rack and pinion gear 58 is mounted in the housing 12. The rack and pinion gear 58 is movable in a first direction to engage the intermediate gear 54 and move the intermediate gear 54 from the disengaged positioned to the engaged position. In FIG. 5, for example, as the rack and pinion gear 58 is moved to the right, it moves the intermediate gear 54 to the right so that it engages and can rotate the disc gear 52. The rack and pinion gear 58 is then movable in a second direction to rotate the intermediate gear 54 and the disc gear 52 as the intermediate gear 54 disengages from the disc gear 52 such that the disc gear 52 freely rotates.

A trigger 60 is attached to the rack and pinion gear 58 and extends through the perimeter wall 16 of the housing 12. A biasing member 62 is positioned in the housing 12 and biases the rack and pinion gear 58 in the second direction. A stop 64 is attached to the rack and pinion gear 58 to engage the disc gear 52 to stop rotation of disc 38 when the biasing member 62 fully moves the rack and pinion gear 58 in the second direction. The trigger 60 can be used by the user allow the disc 38 to continue to rotate by preventing the stop 64 from engaging the disc gear 52.

In use, the housing 12 is used as a conventional dugout for holding material to be smoked and a small pipe or other device capable of holding and burning tobacco, cannabis or other smoking material. When sitting in a group, multiple persons will take turns causing the disc 38 to rotate wherein the pointer 46 will direct the user of the disc 38 as to which action they are to perform.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A container and spinner combination assembly wherein the container is configured to retain articles for smoking, said assembly comprising:

a housing having a bottom wall and a perimeter wall being attached to and extending upwardly from said bottom wall, said perimeter wall including a front wall, a rear wall, a first side wall and a second side wall, said housing having a top side having a first opening and a second opening extending therethrough;

a first compartment being positioned in said housing adjacent to said first side wall and having an interior being aligned with said first opening, a second compartment being positioned in said housing adjacent to said second side wall and having an interior aligned with said second opening, said first and second openings being closable;

a disc being rotatably mounted on said housing, said disc having an outer surface facing away from said housing, said outer surface having indicia thereon dividing said outer surface into a plurality of sections, each of said sections having an action indicia thereon; and a pointer being mounted on said housing, said pointer extending over said outer surface and indicating one of said sections after rotation of said disc terminates;

a spin actuator being mechanically coupled to said disc, said spin actuator being actuated to cause said disc to rotate, wherein said spin actuator includes a disc gear being mounted on a backside of said disc, an intermediate gear being rotatably mounted to said housing, said intermediate gear being mounted in a slot such that said intermediate gear is movable between an engaged position engaging said disc gear and a disengaged positioned being disengaged from said disc gear, a rack and pinion gear being mounted in said housing, said rack and pinion gear being movable in a first direction to engage said intermediate gear and move said intermediate gear from said disengaged positioned to said engaged position, said rack and pinion gear being movable in a second direction to rotate said intermediate gear and said disc gear as said intermediate gear disengages from said disc gear such that said disc gear freely rotates, and a trigger being attached to said rack and pinion gear and extending through said perimeter wall of said housing.

2. The container and spinner combination assembly according to claim 1, further including a door being positioned on said housing, said door being movable to open or close said first and second openings.

3. The container and spinner combination assembly according to claim 1, wherein said spin actuator further includes a biasing member being positioned in said housing and biasing said rack and pinion gear in said second direction.

4. The container and spinner combination assembly according to claim 3, wherein said spin actuator further includes a stop being attached to said rack and pinion gear, said stop engaging said disc gear to stop rotation of disc when said biasing member fully moves said rack and pinion gear in said second direction.

5. The container and spinner combination assembly according to claim 1, wherein said front wall has an aperture therein, said disc being positioned in said housing and being viewable through said aperture, said pointer being mounted on said front wall and extending over said aperture.

6. The container and spinner combination assembly according to claim 1, wherein said front wall has an aperture therein, said disc being positioned in said housing and being viewable through said aperture, said pointer being mounted on said front wall and extending over said aperture.

7. A container and spinner combination assembly wherein the container is configured to retain articles for smoking, said assembly comprising:

a housing having a bottom wall and a perimeter wall being attached to and extending upwardly from said bottom wall, said perimeter wall including a front wall, a rear wall, a first side wall and a second side wall, said housing having a top side having a first opening and a second opening extending therethrough;

a first compartment being positioned in said housing adjacent to said first side wall and having an interior being aligned with said first opening, a second compartment being positioned in said housing adjacent to said second side wall and having an interior aligned with said second opening;

a door being positioned on said housing, said door being movable to open or close said first and second openings;

a disc being rotatably mounted on said housing, said disc having an outer surface facing away from said housing, said outer surface having indicia thereon dividing said outer surface into a plurality of sections, each of said sections having an action indicia thereon;

a pointer being mounted on said housing, said pointer extending over said outer surface and indicating one of said sections after rotation of said disc terminates;

a spin actuator being mechanically coupled to said disc, said spin actuator being actuated to cause said disc to rotate, said spin actuator including:

a disc gear being mounted on a backside of said disc;

an intermediate gear being rotatably mounted to said housing, said intermediate gear being mounted in a slot such that said intermediate gear is movable between an engaged position engaging said disc gear and a disengaged positioned being disengaged from said disc gear;

a rack and pinion gear being mounted in said housing, said rack and pinion gear being movable in a first direction to engage said intermediate gear and move said intermediate gear from said disengaged positioned to said engaged position, said rack and pinion gear being movable in a second direction to rotate said intermediate gear and said disc gear as said intermediate gear disengages from said disc gear such that said disc gear freely rotates;

a trigger being attached to said rack and pinion gear and extending through said perimeter wall of said housing;

a biasing member being positioned in said housing and biasing said rack and pinion gear in said second direction;

a stop being attached to said rack and pinion gear, said stop engaging said disc gear to stop rotation of disc when said biasing member fully moves said rack and pinion gear in said second direction; and said front wall having an aperture therein, said disc being positioned in said housing and being viewable through said aperture, said pointer being mounted on said front wall and extending over said aperture.

* * * * *